US011634909B2

(12) United States Patent
Cramer

(10) Patent No.: US 11,634,909 B2
(45) Date of Patent: Apr. 25, 2023

(54) ADJUSTABLE HEIGHT REBAR CHAIR

(71) Applicant: OCM Inc., Grayslake, IL (US)

(72) Inventor: Andy Cramer, Johnsburg, IN (US)

(73) Assignee: OCM, Inc., Grayslake, IL (US)

( * ) Notice: Subject to any disclaimer, the term of this patent is extended or adjusted under 35 U.S.C. 154(b) by 14 days.

(21) Appl. No.: 17/468,798

(22) Filed: Sep. 8, 2021

(65) Prior Publication Data

US 2023/0071972 A1 Mar. 9, 2023

(51) Int. Cl.
*E04C 5/16* (2006.01)
*E04C 5/20* (2006.01)

(52) U.S. Cl.
CPC ..... *E04C 5/168* (2013.01); *E04C 5/201* (2013.01); *E04C 5/206* (2013.01)

(58) Field of Classification Search
CPC . E04C 5/168; E04C 5/20; E04C 5/206; E04C 5/201
See application file for complete search history.

(56) References Cited

U.S. PATENT DOCUMENTS 3,115,726 A * 12/1963 Sayles ..... E04F 21/05 404/136
4,835,933 A * 6/1989 Yung ..... E04C 5/168 52/685
5,058,348 A * 10/1991 Westhed ..... E04F 21/05 52/126.6
5,555,693 A * 9/1996 Sorkin ..... E04C 5/20 52/687
5,595,039 A * 1/1997 Lowery ..... E04C 5/206 52/678
5,819,493 A 10/1998 LeMoignan
6,178,716 B1 * 1/2001 Chen ..... E04C 5/20 404/136
6,276,108 B1 * 8/2001 Padrun ..... E04C 5/167 52/686
6,367,764 B1 4/2002 Butler
(Continued)

FOREIGN PATENT DOCUMENTS

CA 1270661 A * 6/1990 ..... E04C 5/20
CN 205804768 12/2016
(Continued)

OTHER PUBLICATIONS

Certified MTP, not title, Jun. 2021, 3 pages, Published in USA.

*Primary Examiner* — Adriana Figueroa
(74) *Attorney, Agent, or Firm* — Liell & McNeil

(57) ABSTRACT

An adjustable height rebar chair includes a threaded rebar support column threadably connected to a tripod base, and each consists of a respective one-piece body of molded plastic. A top end of the rebar support column terminates in an adjustment handle that defines first and second concave rebar cradles that are orthogonal to each other. The rebar support column also includes a vertical surface extending from the adjustment handle toward a bottom end of a threaded rod, and the vertical surface has numerical indicia that decrease in magnitude in a direction toward the adjustment handle. A number of the numerical indicia that is located next to a top of the central core corresponds to a distance along a vertical centerline from the three feet of the tripod base to at least one of the first and second concave rebar cradles.

17 Claims, 3 Drawing Sheets

(56) References Cited

U.S. PATENT DOCUMENTS

| | | | | |
|---|---|---|---|---|
| 10,450,751 | B2 | 10/2019 | Rush | |
| 10,896,774 | B2 * | 1/2021 | Stilwell | H02G 15/00 |
| 10,975,565 | B2 * | 4/2021 | Gilman | F16M 11/32 |
| 2004/0206030 | A1 * | 10/2004 | Juedes | E04C 5/168 52/384 |
| 2007/0157542 | A1 | 7/2007 | Peterson, Jr. | |
| 2017/0233999 | A1 * | 8/2017 | Gilman | E04B 1/41 248/542 |
| 2020/0080664 | A1 * | 3/2020 | Perry | F16L 3/18 |

FOREIGN PATENT DOCUMENTS

| | | | | |
|---|---|---|---|---|
| CN | 212534820 | | 2/2021 | |
| FR | 2911352 | A1 * | 7/2008 | E04C 5/206 |

* cited by examiner

ADJUSTABLE HEIGHT REBAR CHAIR

TECHNICAL FIELD

The present disclosure relates generally to rebar support chairs used in concrete work, and more particularly to a vertically adjustable rebar chair.

BACKGROUND

Rebar chars are devices used to support rebar in a concrete form while concrete is being poured into the form to create reinforced concrete. Rebar chars are usually formed of metal or plastic and often come in various discrete heights to allow the user to support rebar at different selected heights in a concrete form. Although these various height chairs are useful, the discrete heights make them difficult to use on uneven terrain and maybe even unsuitable when the desired rebar height in the form is somewhere between available chair heights.

The present disclosure is directed to one or more of the problems set forth above.

SUMMARY OF THE DISCLOSURE

An adjustable height rebar chair includes a tripod base consisting of a one-piece body of molded plastic that defines a vertical centerline and includes three feet separated from a central core by three legs, respectively. The central core defines a threaded bore that is concentric with the vertical centerline. A rebar support column consists of a one-piece body of molded plastic that includes a threaded rod, which is threadably received in the threaded bore. The threaded rod terminates at a top end in an adjustment handle that defines a first concave rebar cradle and a second concave rebar cradle oriented perpendicular to the first concave rebar cradle. The rebar support column includes a vertical surface extending from the adjustment handle toward a bottom end of the threaded rod, and the vertical surface has numerical indicia that decrease in magnitude in a direction toward the adjustment handle. A number of the numerical indicia that is located next to a top of the central core corresponds to a distance along the vertical centerline from the three feet to at least one of the first concave rebar cradle and the second concave rebar cradle.

DETAILED DESCRIPTION

Figure 4:
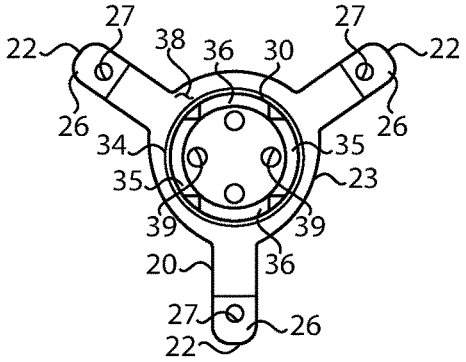
FIG. 4 is a top view of the rebar chair of FIG. 1.
Figure 2:
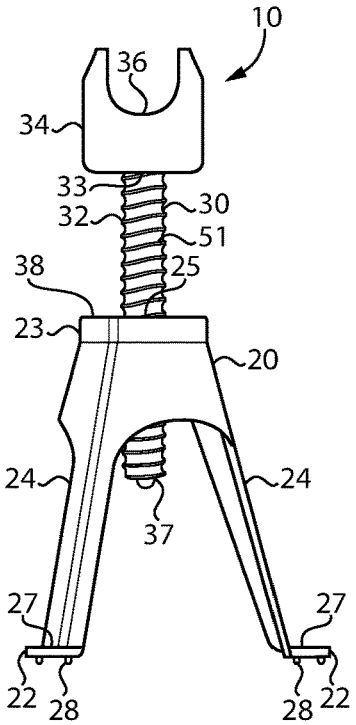
FIG. 2 is a left side view of the rebar chair of FIG. 1.
Figure 1:
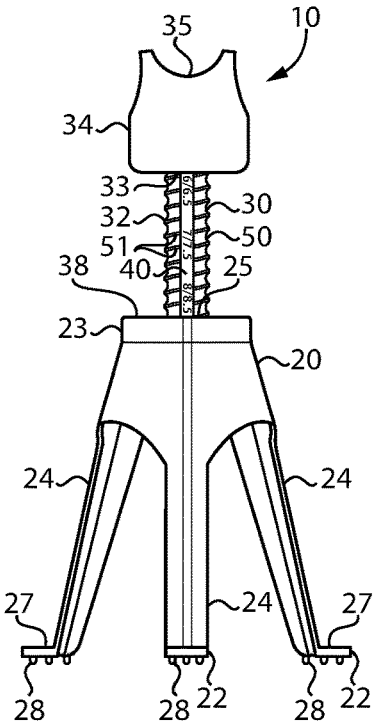
FIG. 1 is a front view of an adjustable height rebar chair according to the present disclosure.
Figure 3:
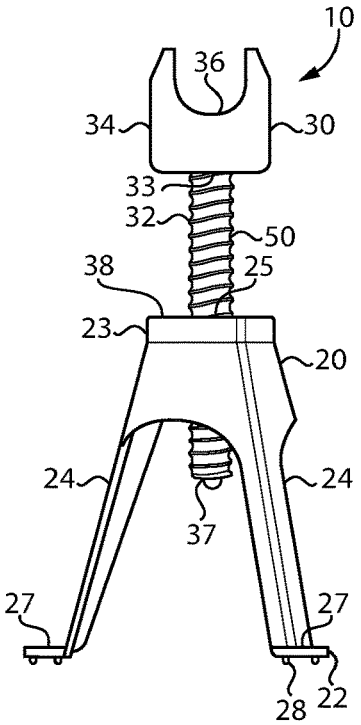
FIG. 3 is a ride side view of the rebar chair of FIG. 1.
Figure 5:
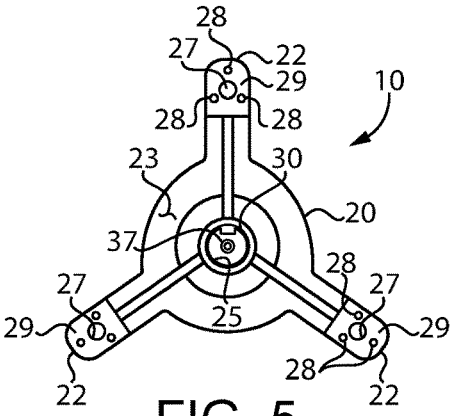
FIG. 5 is a bottom view of the rebar chair of FIG. 1.
Figure 6:
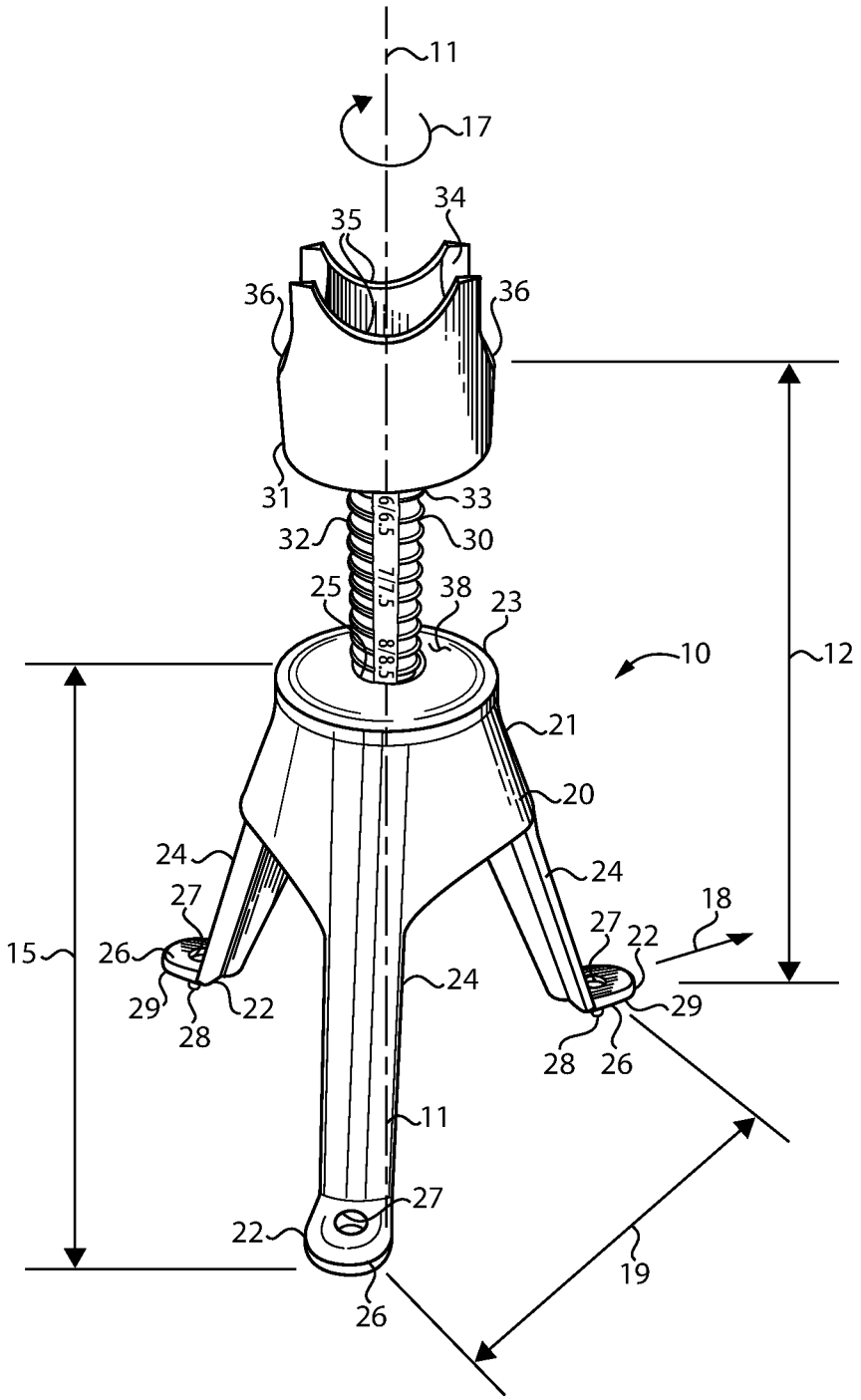
FIG. 6 is a perspective view of the rebar chair of FIG. 1.
Figure 7:
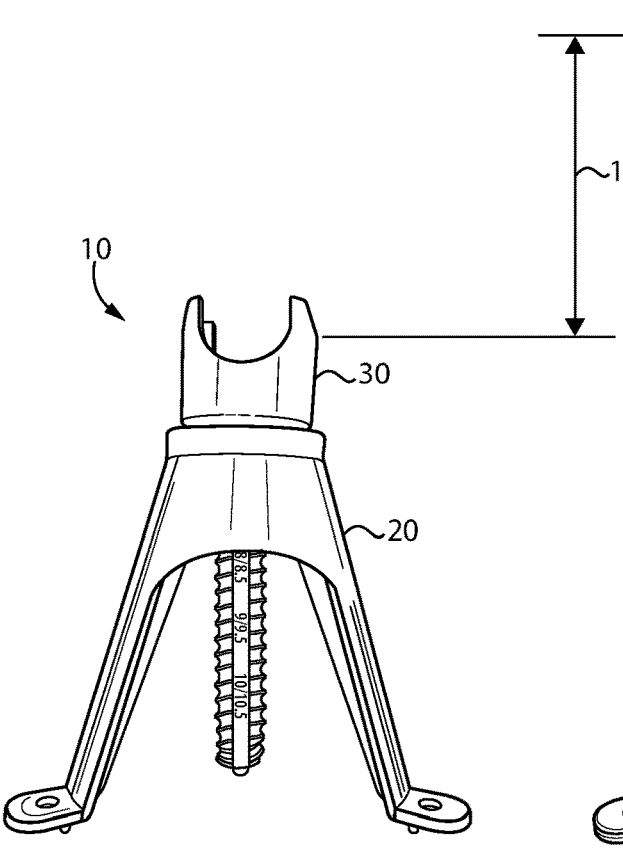
FIG. 7 is a side view showing the rebar chair of FIG. 1 at a minimum height.
Figure 8:
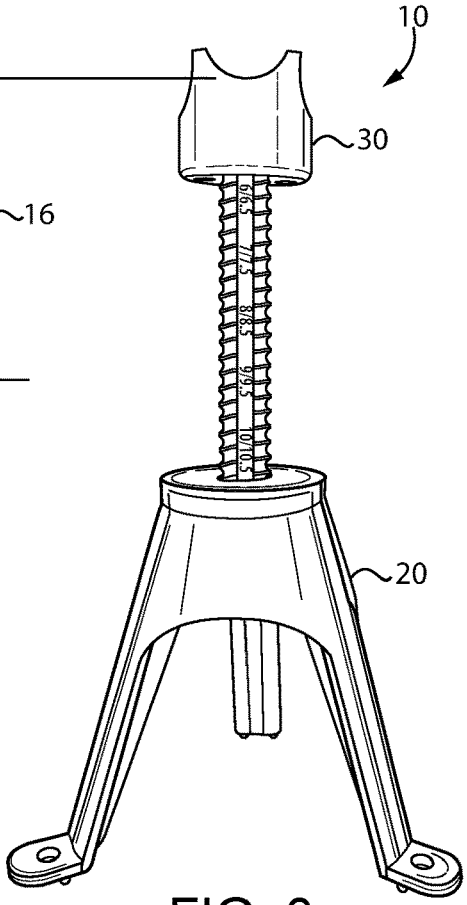
FIG. 8 is a side view of the rebar chair of FIG. 1 at a maximum height.
Figure 9:
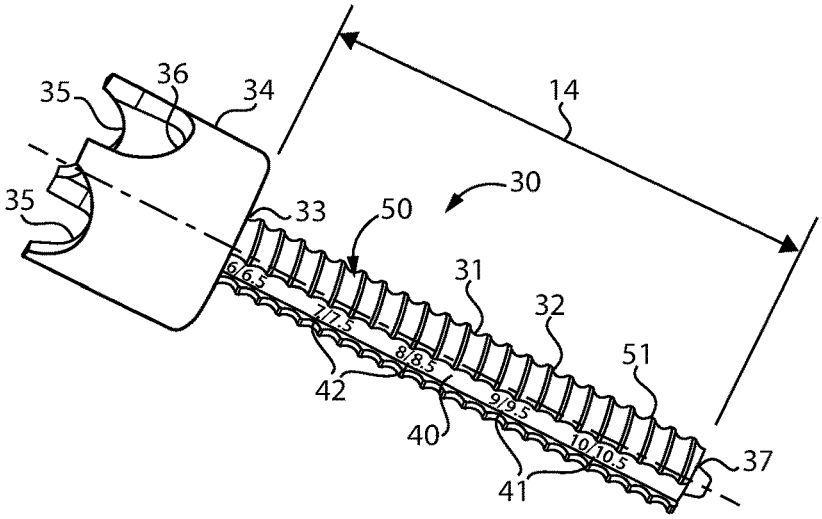
FIG. 9 is a perspective view of a rebar support column from the rebar chair of FIG. 1

Referring now to the figures, an adjustable height rebar chair 10 includes a rebar support column 30 threadably attached to a tripod base 20. The tripod base 20 consists of a one-piece body 21 of molded plastic that includes three feet 22 separated from a central core 23 by three legs 24, respectively. The central core 23 defines a threaded bore 25 that is concentric with a vertical centerline defined by the adjustable height rebar chair 10. The rebar support column 30 also consists of a one-piece body 31 of molded plastic that includes a threaded rod 32 that terminates at a top end 33 in an adjustment handle 34. The threaded rod 32 is threadably received in the threaded bore 25. The adjustment handle 34 defines a first concave support cradle 36 and a second concave support cradle 37 that is oriented perpendicular to the first concave rebar support cradle 36. The first and second concave rebar cradles 36,37 may be positioned anywhere in a continuous range of heights 16 responsive to a threaded position 17 of the threaded rod 32 in the threaded bore 25.

In order to aid a user in setting a height of the rebar chair 10, the rebar support column 30 includes a vertical surface 40 that extends from the adjustment handle 34 toward a bottom end 37 of the threaded rod 32. The vertical surface 40 preferably breaks a continuity of the thread pattern 50 of the threaded rod 32, and the vertical surface is closer to the vertical centerline 12 than the spiral thread pattern 50. The vertical surface 40 has numerical indicia 41 that decrease in magnitude in a direction toward the adjustment handle 34. The number 42 of the numerical indicia 41 that is located next to a top surface 38 of the central core 23 corresponds to a distance 12 along the vertical centerline 12 from the three feet 22 to at least one of the first concave rebar cradle 36 and the second concave rebar cradle 37. In the illustrated embodiment the numerical indicia include five groups of numbers (6/6.5, 7/7.5, 8/8.5, 9/9.5 and 10/10.5) arranged in a series one inch apart. This numerical indicia recognizes that the first and second rebar cradles 36, 37 differ in height by one half inch so that the cradles can support orthogonal rebar simultaneously in the two cradles at respective heights that differ by one half inch. Thus, for example, if the numbers 7/7.5 are next to the top surface 38 of the central core 23, the first and second cradles are 7 and 7½ inches above feet 22 along vertical centerline 11. The first and second rebar cradles 36, 37 can be positioned anywhere in a continuous range of heights 16 responsive to a threaded position 17 of the threaded rod 32 in the threaded bore 25. In the illustrated embodiment, this continuous range of heights 16 is six to ten inches for one of the rebar cradles 36, 37.

In the illustrated embodiment, the adjustment handle 34 might take the form of an upturned cup in which the rim of the cup is shaped to define the first and second rebar cradles 36, 37. When molded into this shape, the adjustment handle 34 might includes a plurality of drain holes 39 that might inhibit water from collecting in the adjustment handle 34 before concrete is poured into the form in which the rebar chairs 10 are positioned.

The tripod base 20 and the rebar support column 30 are preferably designed such that the threaded rod 32 cannot be threaded so far into the threaded bore 25 that a bottom end 37 of the threaded rod 32 interferes with the support provided by the three feet 22. Thus, the threaded rod 32 preferably has a length 14 that is less than a distance 15 along the vertical centerline 12 of the feet 22 to a top surface 38 of the central core 23.

In order to maybe enhance stability in the field, each of the three feet 22 might include a horizontal pad 26 that extends from one of the respective legs 24 in a direction 18 away from the vertical centerline 12. Each of the horizontal pads 26 might define a ground connection bore 27 oriented parallel to the vertical centerline 12 and sized to receive a fastener, such as a nail, there through. Each of the horizontal pads 26 might also include three protrusions 28 that extend downward from a bottom side 29 and are distributed around the respective ground connection bore 27. Stability may be further enhanced by sizing the three feet 22 to be separated from each other by a distance 19 about equal to a length of the threaded rod 32.

In order to provide even more versatility for concrete work, both the threaded bore 25 and the threaded rod 32 have thread patterns 50 that correspond to a standard concrete construction coil thread 51 that permits the tripod base 20 to be mated with other concrete construction hardware that have the standard construction coil thread 51. This construction hardware includes steel rod, steel coil bolts and steel cradle holders, which are known in the art. The threaded rod 32 can receive coil thread nuts having matching coil threads 51.

INDUSTRIAL APPLICABILITY

The adjustable height rebar chair 10 of the present disclosure finds general application in concrete work. The adjustable rebar chair 10 is applicable to concrete forming where uneven terrain or other factors that require rebar chairs of varying heights in order to position rebar at a desired height in a concrete form. The present disclosure also finds applicability to concrete work where the desired rebar height falls between the discrete heights associated with available rebar chairs. The present disclosure finds specific applicability to instances where there is a desire to position rebar in a concrete form at a continuum of different heights, and specifically from six to ten inches in height.

Adjustable height rebar chair 10 may be simply adjusted by a user gripping the tripod base 20 in one hand and the adjustment handle 34 with an other hand. The user then rotates the adjustment handle 34 with respect to the tripod base through a continuum of threaded positions 17 until arriving at a position where the desired height number 42 on the vertical surface 40 next to a top surface 38 of the central core 23 is the desired height. The user then may position the rebar chair 10 in the concrete form so that the cradles 36, 37 align with the desired orientation of rebar in the concrete form. If desired, the rebar chair 10 may be secured in place, such as by driving nails through the ground connection bores 27 into the substrate supporting the rebar chair 10.

The present description is for illustrative purposes only, and should not be construed to narrow the breadth of the present disclosure in any way. Thus, those skilled in the art will appreciate that various modifications might be made to the presently disclosed embodiment without departing from the full and fair scope and spirit of the present disclosure. Other aspects, features and advantages will be apparent upon an examination of the attached drawings and appended claims.

LIST OF ELEMENTS

10. Adjustable height rebar chair
11. Vertical centerline
12. Distance
14. Length
15. Distance
16. Range of heights
17. Threaded position
18. Direction
19. Distance
20. Tripod base
21. One-piece body
22. Feet
23. Central core
24. Leg
25. Threaded bore
26. Horizontal pad
27. Ground connection bore
28. Protrusion
29. Bottom side
30. Rebar support column
31. One-piece body
32. Threaded rod
33. Top end
34. Adjustment handle
35. Concave rebar cradle
36. Concave rebar cradle
37. Bottom end
38. Top surface
39. Drain hole
40. Vertical surface
41. Numerical indicia
42. Number
50. Thread pattern
51. Coil thread

What is claimed is:

1. An adjustable height rebar chair comprising:

a tripod base consisting of a one-piece body of molded plastic that defines a vertical centerline and includes three feet separated from a central core by three legs, respectively, and the central core defining a threaded bore that is concentric with the vertical centerline, and the three leas extend downward from the central core toward the three feet;

a rebar support column consisting of a one-piece body of molded plastic that includes a threaded rod, which is threadably received in the threaded bore, that terminates at a top end in an adjustment handle that defines a first concave rebar cradle and a second concave rebar cradle oriented perpendicular to the first concave rebar cradle;

the rebar support column includes a vertical surface extending from the adjustment handle toward a bottom end of the threaded rod, and the vertical surface having numerical indicia that decrease in magnitude in a direction toward the adjustment handle; and wherein a number of the numerical indicia that is located next to a top of the central core corresponds to a distance along the vertical centerline from the three feet to at least one of the first concave rebar cradle and the second concave rebar cradle.

2. The rebar chair of claim 1 wherein the adjustment handle defines a drain hole that inhibits water from collecting in the adjustment handle.

3. The rebar chair of claim 1 wherein the threaded rod has a length that is less than a distance along the vertical centerline of the feet to a top surface of the central core so that the threaded rod cannot be threaded so far into the threaded bore that a bottom end of the threaded rod interferes with support provided by the three feet.

4. The rebar chair of claim 1 wherein the first concave rebar cradle can be positioned anywhere in a continuous range of heights responsive to a threaded position of the threaded rod in the threaded bore.

5. The rebar chair of claim 4 wherein the continuous range of heights includes from six to ten inches.

6. The rebar chair of claim 1 wherein each of the three feet includes a horizontal pad that extends from one of the respective three legs in a direction away from the vertical centerline.

7. The rebar chair of claim 6 wherein each of the horizontal pads defines a ground connection bore oriented parallel to the vertical centerline and sized to receive a fastener there through.

8. The rebar chair of claim 7 wherein each of the horizontal pads includes three protrusions that extend downward from a bottom side and are distributed around the respective ground connection bore.

9. The rebar chair of claim 1 wherein the threaded bore has a thread pattern corresponding to a standard concrete construction coil thread that permits the tripod base to be mated to other concrete construction hardware that has the standard concrete construction coil thread.

10. The rebar chair of claim 1 wherein the three feet are separated from each other by a distance about equal to a length of the threaded rod.

11. The rebar chair of claim 1 wherein the vertical surface breaks a continuity of a spiral thread pattern of the threaded rod, and the vertical surface is closer to the vertical centerline than the spiral thread pattern.

12. The rebar chair of claim 11 wherein the threaded bore has a thread pattern corresponding to a standard concrete construction coil thread that permits the tripod base to be mated to other concrete construction hardware that has the standard concrete construction coil thread.

13. The rebar chair of claim 12 wherein each of the three feet includes a horizontal pad that extends from one of the respective three legs in a direction away from the vertical centerline;

wherein each of the horizontal pads defines a ground connection bore oriented parallel to the vertical centerline and sized to receive a fastener there through; and wherein each of the horizontal pads includes three protrusions that extend downward from a bottom side and are distributed around the respective ground connection bore.

14. The rebar chair of claim 13 wherein the first concave rebar cradle can be positioned anywhere in a continuous range of heights responsive to a threaded position of the threaded rod in the threaded bore; and the continuous range of heights includes from six to ten inches.

15. The rebar chair of claim 14 wherein the threaded rod has a length that is less than a distance along the vertical centerline of the feet to a top surface of the central core; and the three feet are separated from each other by a distance about equal to the length of the threaded rod.

16. The rebar chair of claim 15 wherein the adjustment handle defines a drain hole that inhibits water from collecting in the adjustment handle.

17. The rebar chair of claim 1 wherein the threaded bore extends through the central core.

* * * * *